US010602819B2

(12) United States Patent
Tan

(10) Patent No.: US 10,602,819 B2
(45) Date of Patent: Mar. 31, 2020

(54) LUGGAGE WITH ROTARY DISPLACEMENT WHEELS

(71) Applicant: Fu-Hsing Tan, Taoyuan Hsien (TW)

(72) Inventor: Fu-Hsing Tan, Taoyuan Hsien (TW)

( * ) Notice: Subject to any disclaimer, the term of this patent is extended or adjusted under 35 U.S.C. 154(b) by 172 days.

(21) Appl. No.: 15/943,935

(22) Filed: Apr. 3, 2018

(65) Prior Publication Data

US 2019/0298020 A1 Oct. 3, 2019

(51) Int. Cl.
*A45C 5/14* (2006.01)

(52) U.S. Cl.
CPC ..... *A45C 5/14* (2013.01); *A45C 2005/142* (2013.01); *A45C 2005/147* (2013.01); *A45C 2005/148* (2013.01)

(58) Field of Classification Search
CPC ..... A45C 5/14; A45C 2005/142; A45C 2005/147; A45C 2005/148
See application file for complete search history.

(56) References Cited

U.S. PATENT DOCUMENTS 2,472,491 A * 6/1949 Quinton ..... A45C 5/146 280/37
4,007,512 A * 2/1977 Oland ..... A45C 5/146 16/19
4,846,493 A * 7/1989 Mason ..... A45C 5/146 280/641
6,814,361 B2 * 11/2004 Tsu ..... B62B 5/0083 280/43.1
7,029,015 B2 * 4/2006 Lin ..... A45C 9/00 190/18 A
8,549,705 B1 * 10/2013 Wu ..... B60B 37/10 16/31 A
8,863,354 B2 * 10/2014 Dayt ..... B60B 7/008 16/45
8,936,257 B2 * 1/2015 Kinnee ..... A45C 5/146 16/44
10,143,279 B2 * 12/2018 Pitchforth ..... A45C 13/04
2017/0367450 A1 * 12/2017 Karl ..... A45C 5/03

* cited by examiner

*Primary Examiner* — Tri M Mai

(57) ABSTRACT

A luggage with rotary displacement wheels includes a luggage body (1) having a giving-away surface (16) located on the junction between the bottom panel (13) and back panel (11) thereof, a rotary displacement wheel (2) mounted to each side panel (15) of the luggage body (1). The rotary displacement wheel (2) includes a wheel holder (21) eccentrically pivoted to one respective side panel (15) near the giving-away surface (16) and a tire (22) pivotally mounted on the wheel holder (21). The wheel holder (21) is turnable relative to the luggage body (1) between a first position near the front panel (12) to let a relatively smaller part of the tire (22) protrude over the giving-away surface (16) and a second position far from the front panel (12) to let a relatively larger part of the tire (22) protrude over the giving-away surface (16).

4 Claims, 12 Drawing Sheets

LUGGAGE WITH ROTARY DISPLACEMENT WHEELS

BACKGROUND OF THE INVENTION

1. Field of the Invention

The present invention relates to luggage technology and more particularly, to a luggage with rotary displacement wheels, which allows adjustment of the rotary displacement wheels between two positions relative to the luggage body, facilitating storage or walking on stairs or uneven road surface.

2. Description of the Related Art

At the bottom of the luggage, wheels are installed so that the luggage can be easily pushed or pulled by the user. At the present, most luggage wheels are small diameter wheels to avoid increasing the overall size of the luggage. However, when moving on an uneven road surface (such as cracked or gravel ground), small diameter wheels can get stuck. Further, when carrying a luggage up or down stairs, the user needs to lift the luggage from stairs and to move the luggage by hand.

When a luggage is equipped with large diameter wheels, the luggage can be conveniently moved on an uneven road surface or stairs, however, the overall size of the luggage will increase, and the support point will be close to the inner side of the luggage body, making the luggage easy to fall down and not convenient for storage.

SUMMARY OF THE INVENTION

The present invention has been accomplished under the circumstances in view. It is therefore the main object of the present invention to provide a luggage with rotary displacement wheels, which allows adjustment of the rotary displacement wheels between a first position close to the luggage body and a second position far from the luggage, facilitating storage or walking on stairs or uneven road surface.

To achieve this and other objects of the present invention, a luggage comprises a luggage body and two rotary displacement wheels. The luggage body comprises a back panel, a front panel, a bottom panel, a top panel and two opposing side panels respectively connected to one another, and a giving-away surface located on the junction between the bottom panel and the back panel and inwardly recessed toward the inside of the luggage body. The rotary displacement wheels are respectively mounted to the side panels of the luggage body, each comprising a wheel holder and a tire pivotally mounted on the wheel holder and peripherally protruding over the giving-away surface of the luggage body. The wheel holder is eccentrically pivoted to one respective side panel and disposed near the giving-away surface, and turnable between a first position near the front panel and a second position far from the front panel.

When going to receive the luggage or to carry the luggage on a smooth road surface, shift the wheel holder to the first position near the front panel to minimize the part of the tire that protrudes over the giving-away surface. When going to carry the luggage on stairs or an uneven road surface, shift the wheel holder to the second position far from the front panel to maximize the part of the tire that protrudes over the giving-away surface.

DETAILED DESCRIPTION OF THE PREFERRED EMBODIMENT

Figure 1:
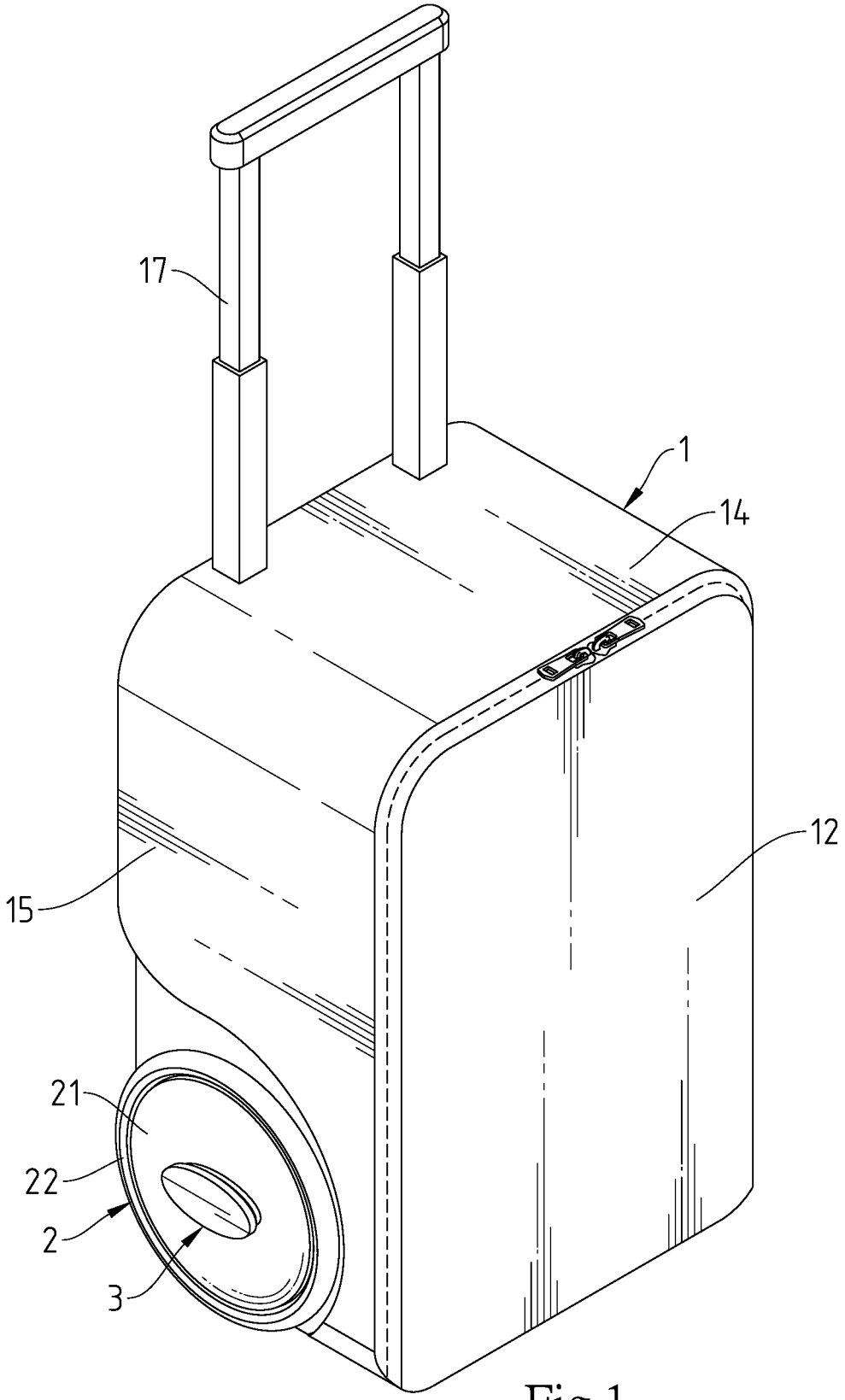
FIG. 1 is an oblique top elevation of a luggage with rotary displacement wheels in accordance with the present invention.

Referring to FIGS. 1-4, a luggage with rotary displacement wheels in accordance with the present invention is shown. The luggage with rotary displacement wheels comprises a luggage body 1, at least one, for example, two rotary displacement wheels 2, and a locking device 3 corresponding to one respective rotary displacement wheel 2.

The luggage body 1 consists of a back panel 11, a front panel 12, a bottom panel 13, a top panel 14 and two opposing side panels 15. Further, the luggage body 1 comprises a giving-away surface 16 located on the junction between the bottom panel 13 and the back panel 11 and inwardly recessed toward the inside of the luggage body 1, and a retractable handle 17 mounted to the back panel 11. In this embodiment, the giving-away surface 16 is circularly arched.

The rotary displacement wheels 2 are respectively mounted to the side panels 15 of the luggage body 1, each comprising a wheel holder 21 and a tire 22 pivotally mounted on the wheel holder 21. The wheel holder 21 is eccentrically pivoted to one respective side panel 15 near the giving-away surface 16, and turnable between a first position near the front panel 12 or a second position far from the front panel 12. The tire 22 is peripherally exposed to the outside of the giving-away surface 16 of the luggage body 1.

The locking device 3 is mounted in the wheel holder 21 of the rotary displacement wheel 2 and adapted for locking the wheel holder 21 to the luggage body 1 in the aforesaid first or second position.

Figure 2:
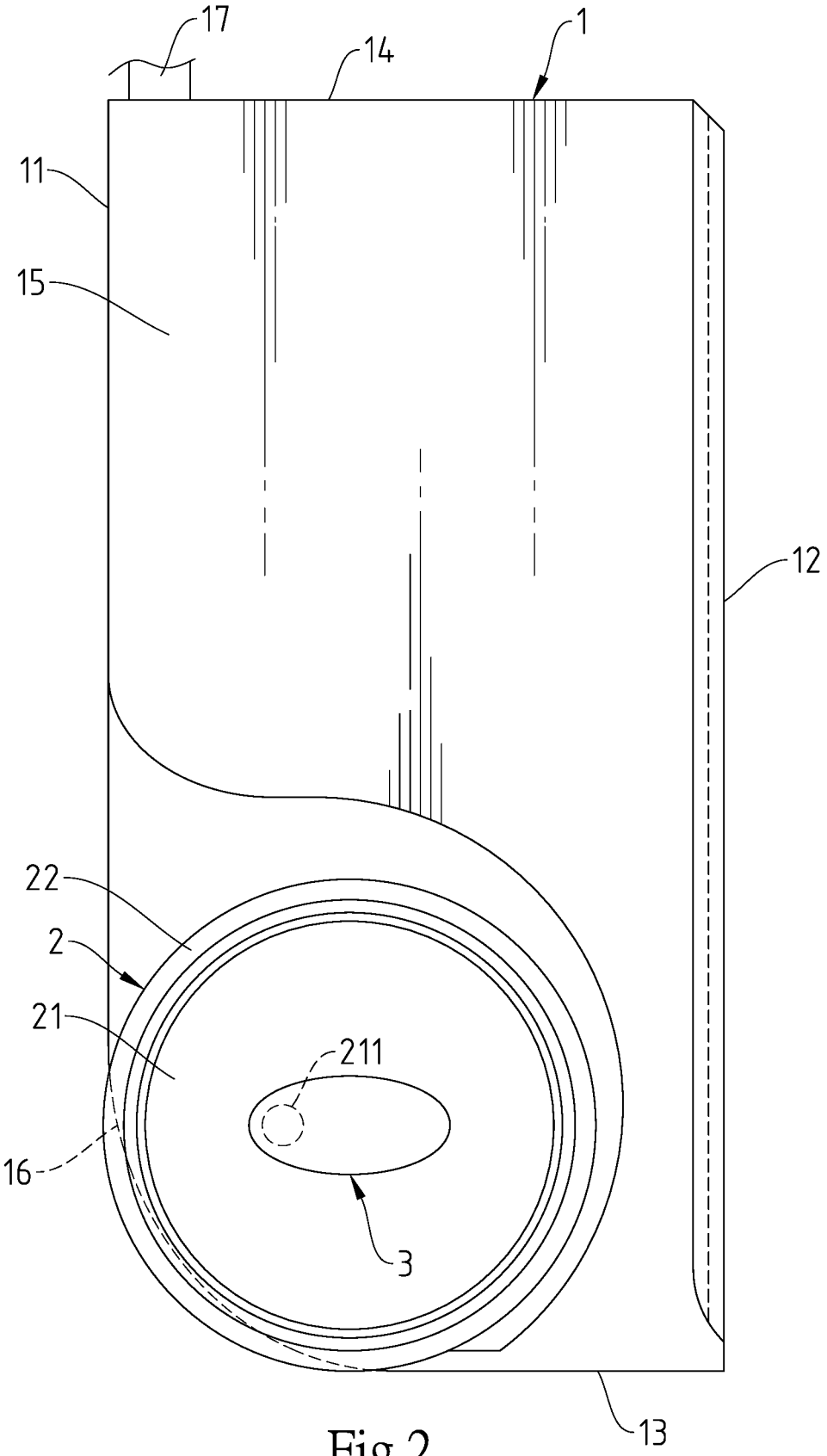
FIG. 2 is a schematic side view of the present invention, illustrating the rotary displacement wheel disposed in the inner side relative to the luggage body.

When the user receives the luggage, as illustrated in FIG. 2, unlock each locking device 3 and turn the wheel holder 21 of each rotary displacement wheel 2 to the first position near the front panel 12, and then uses the locking device 3 to lock the wheel holder 21 of the respective rotary displacement wheel 2 to the luggage body 1 in the first position. At this time, only a small part of the tire 22 of each rotary displacement wheel 2 protrudes over the giving-away surface 16 of the luggage body 1, and thus, the user can rest the bottom panel 13 on the floor. When the user wishes to drag the luggage, the user can tilt the retractable handle 17 and the luggage body 1, enabling the part of the tire 22 that protrudes over the giving-away surface 16 to be kept in contact with the floor.

Figure 3:
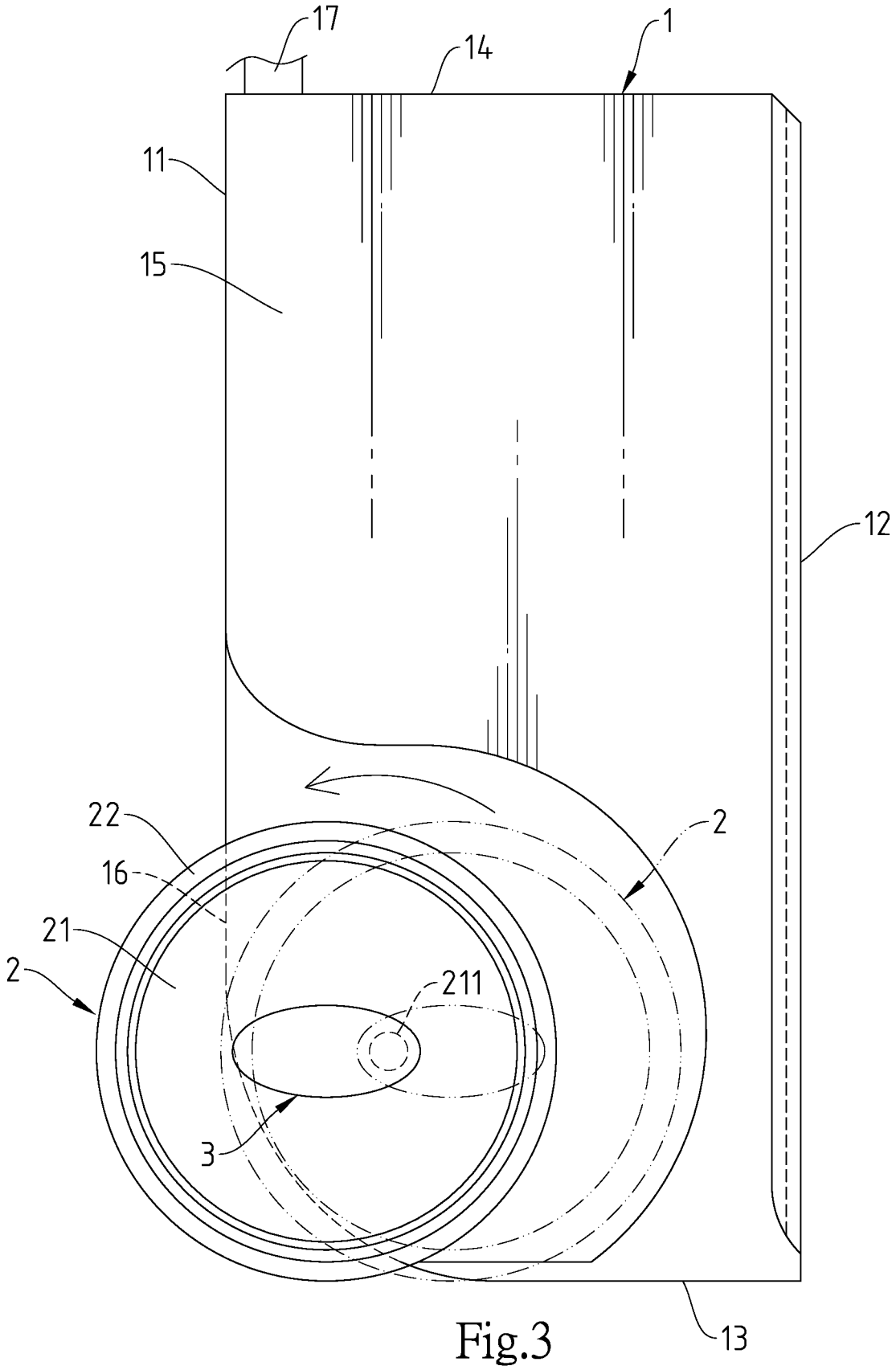
FIG. 3 is a schematic drawing of the present invention, illustrating the rotary displacement wheel moved toward the outer side relative to the luggage body.
Figure 4:
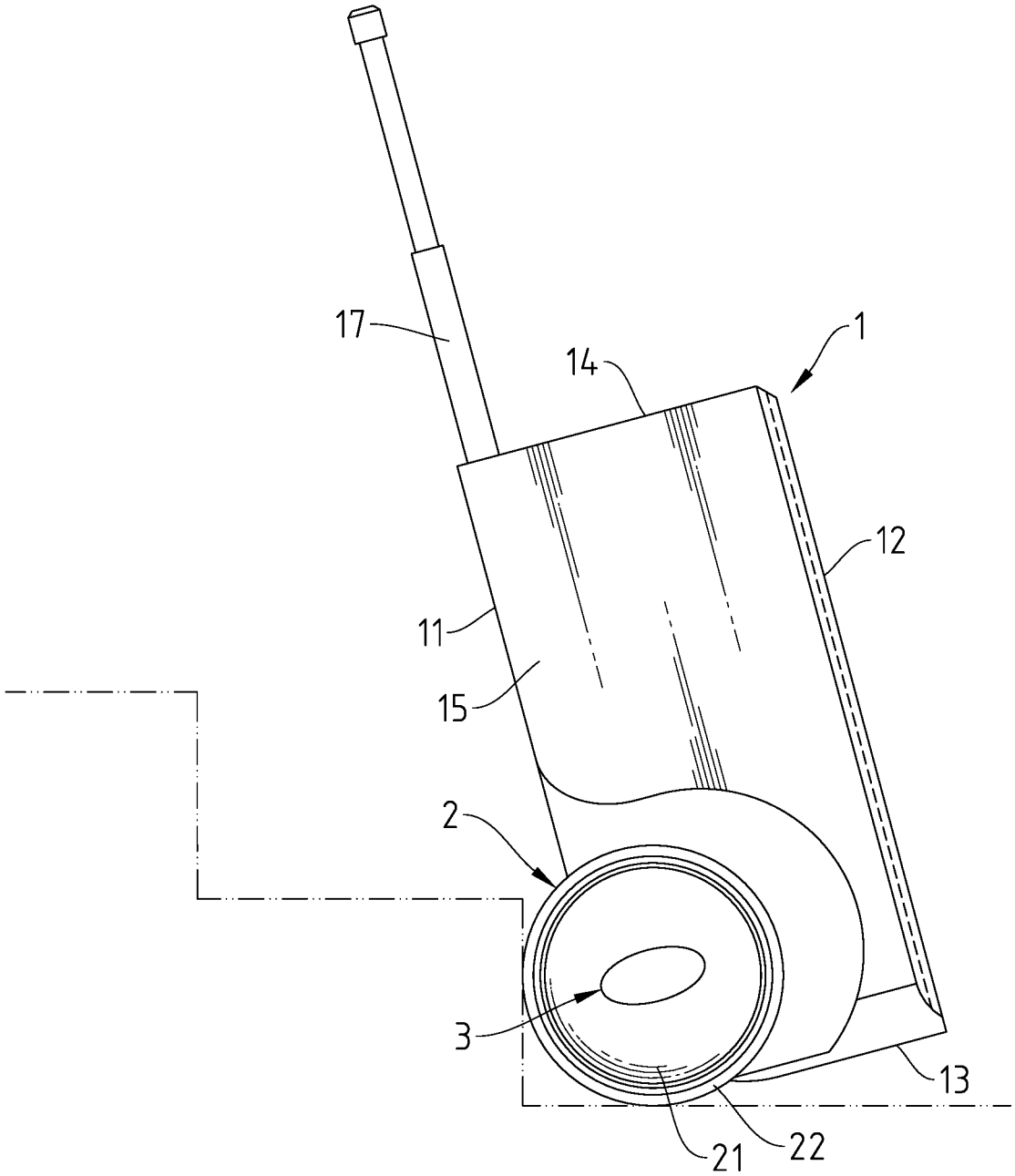
FIG. 4 is a schematic applied view of the present invention, illustrating the luggage moved on stairs.

When the user wants to walk the luggage on stairs or an uneven road surface, as shown in FIGS. 3 and 4, unlock each locking device 3 and turn the wheel holder 21 of each rotary displacement wheel 2 to the second position far from the front panel 12, and then uses the locking device 3 to lock the wheel holder 21 of the respective rotary displacement wheel 2 to the luggage body 1 in the second position. At this time, a relatively larger part of the tire 22 of each rotary displacement wheel 2 protrudes over the giving-away surface 16 of the luggage body 1. Further, when the wheel holder 21 is shifted from the first position to the second position far from the front panel 12, the fulcrum is also shifted outward, letting the luggage body 1 in the parking be not prone to dumping.

Referring to FIGS. 5-8, the luggage body 1 comprises a pivot hole 151 located on each side panel 15, a circularly arched sliding groove 152 located on each side panel 15 around the respective pivot hole 151 and disposed far from the bottom panel 13, a first positioning hole 153 located on each side panel 15 at one end of the respective circularly arched sliding groove 152 near the front panel 12, and a second positioning hole 154, and a second positioning hole 154 located on each side panel 15 at an opposite end of the respective circularly arched sliding groove 152 near the back panel 11. Further, the connection line between the pivot hole 151 and the second positioning hole 154 on each side panel 15 is parallel to the bottom panel 13. The wheel holder 21 of each rotary displacement wheel 2 comprises an eccentric axle 211 perpendicularly located on one side thereof and pivotally connected to the pivot hole 151 on one respective side panel 15, and a through hole 212 and a position-limiting hole 213 cut through two opposite sides thereof in parallel to the eccentric axle 211. Each locking device 3 comprises a positioning plate 31 attached to one side of the wheel holder 21 of one respective rotary displacement wheel 2 opposite to the eccentric axle 211, a positioning post 32 perpendicularly extended from one side of the positioning plate 31 and inserted through the through hole 212 of the wheel holder 21 of the respective rotary displacement wheel 2 into the circularly arched sliding groove 152 on the respective side panel 15.

Each locking device 3 further comprises a position-limiting post 33 perpendicularly extended from the same side of the positioning plate 31 and inserted into the position-limiting hole 213 of the wheel holder 21 of the respective rotary displacement wheel 2, a spring member 34 mounted on the position-limiting post 33 for imparting an elastic restoring energy to the positioning plate 31 when the positioning plate 31 is moved in direction away from the wheel holder 21 of the respective rotary displacement wheel 2, and a locating member 35 affixed to a distal end of the position-limiting post 33 with a fastening member 36 to stop the position-limiting post 33 from falling out of the position-limiting hole 213.

Figure 5:
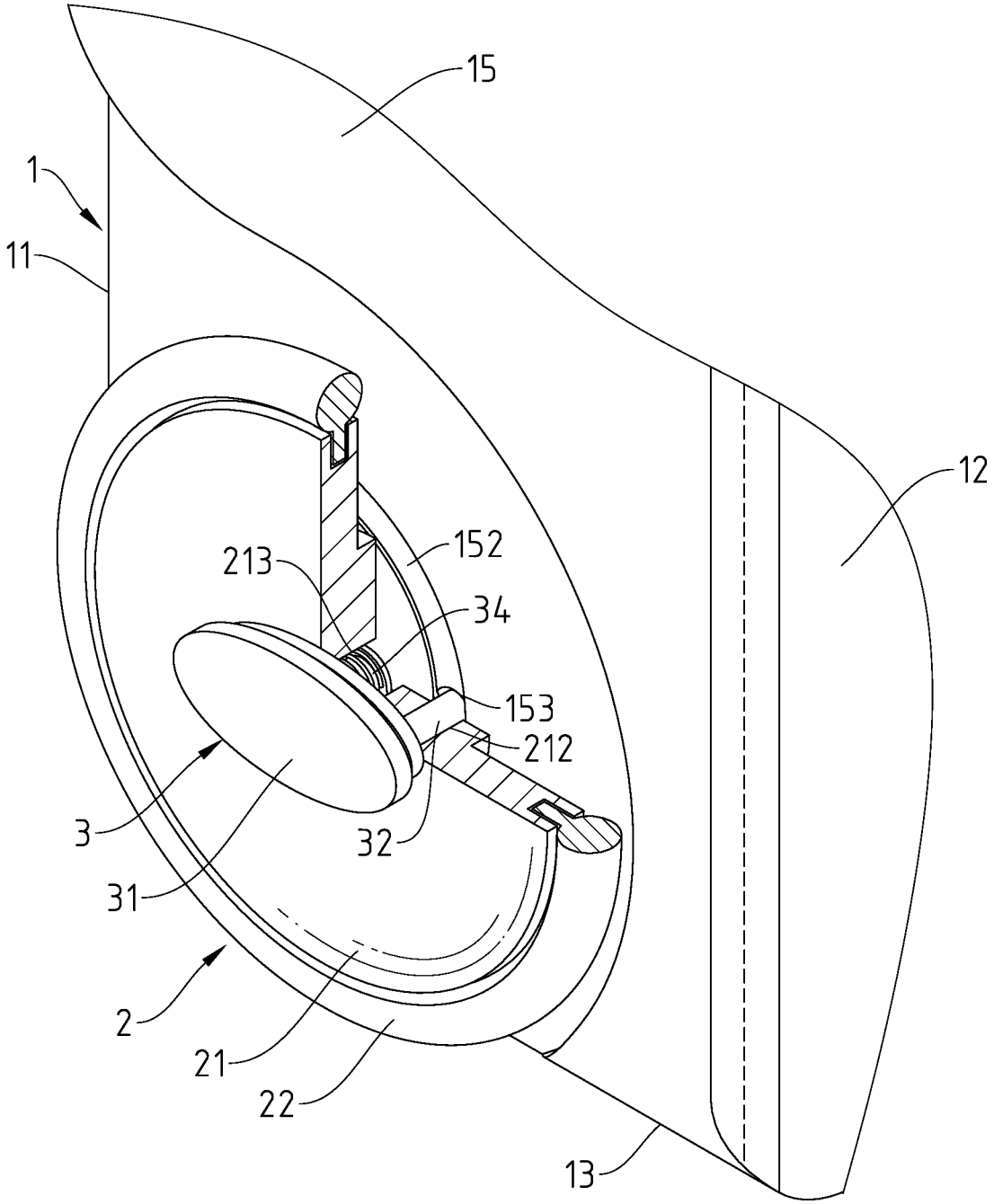
FIG. 5 is a sectional elevation of a part of the present invention, illustrating the rotary displacement wheel disposed in the inner side relative to the luggage body.
Figure 6:
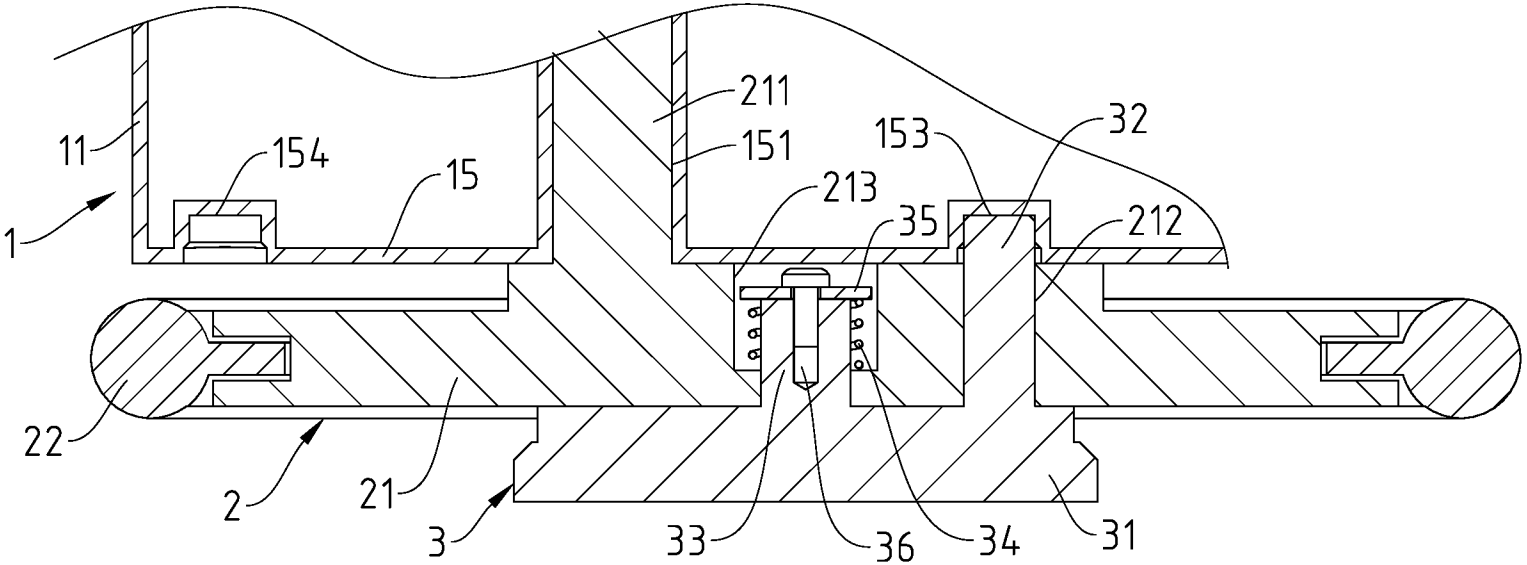
FIG. 6 is a schematic sectional view of the present invention, illustrating the rotary displacement wheel disposed in the inner side relative to the luggage body.
Figure 7:
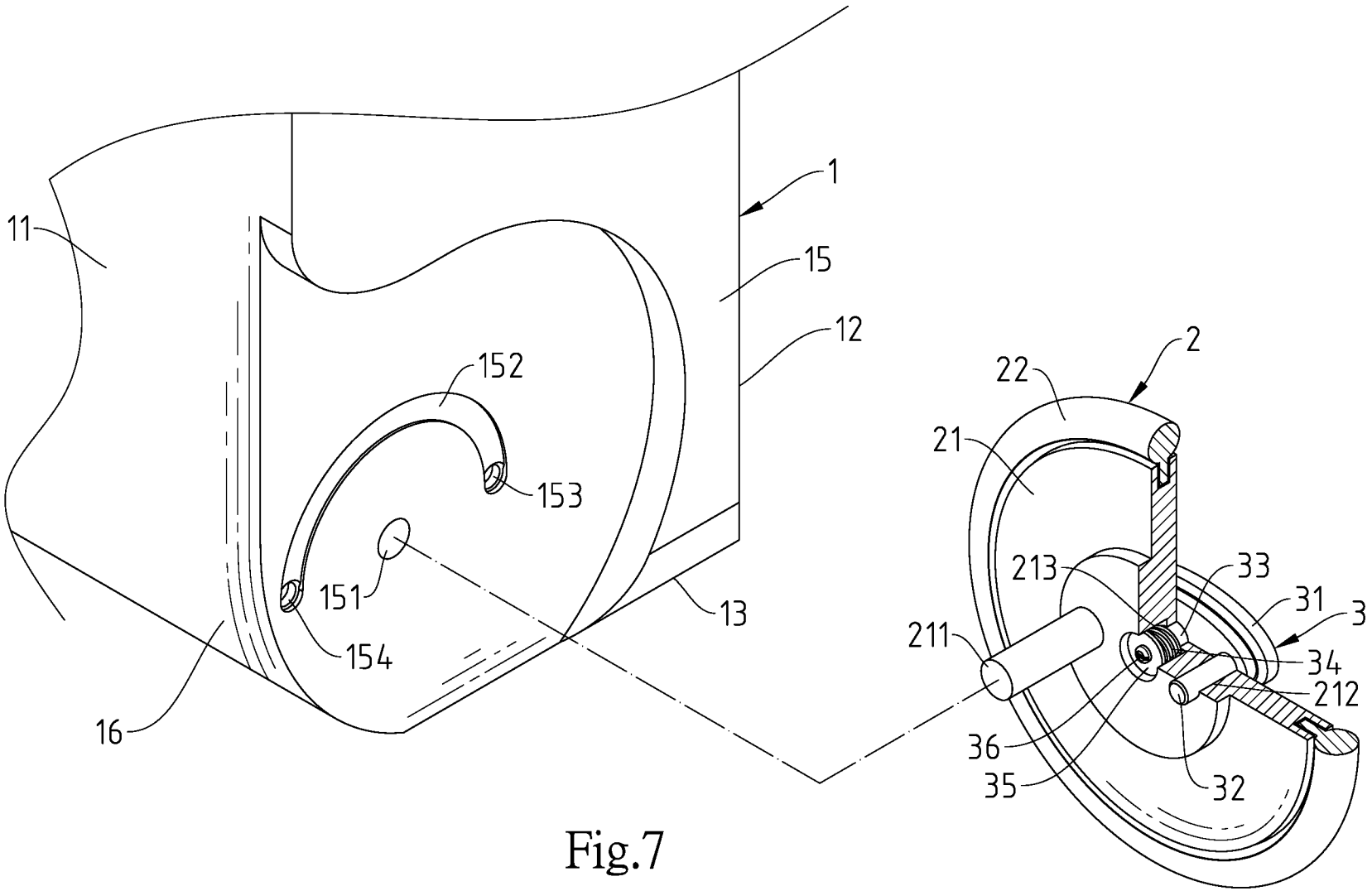
FIG. 7 is an exploded view of the rotary displacement wheel and the luggage body.
Figure 8:
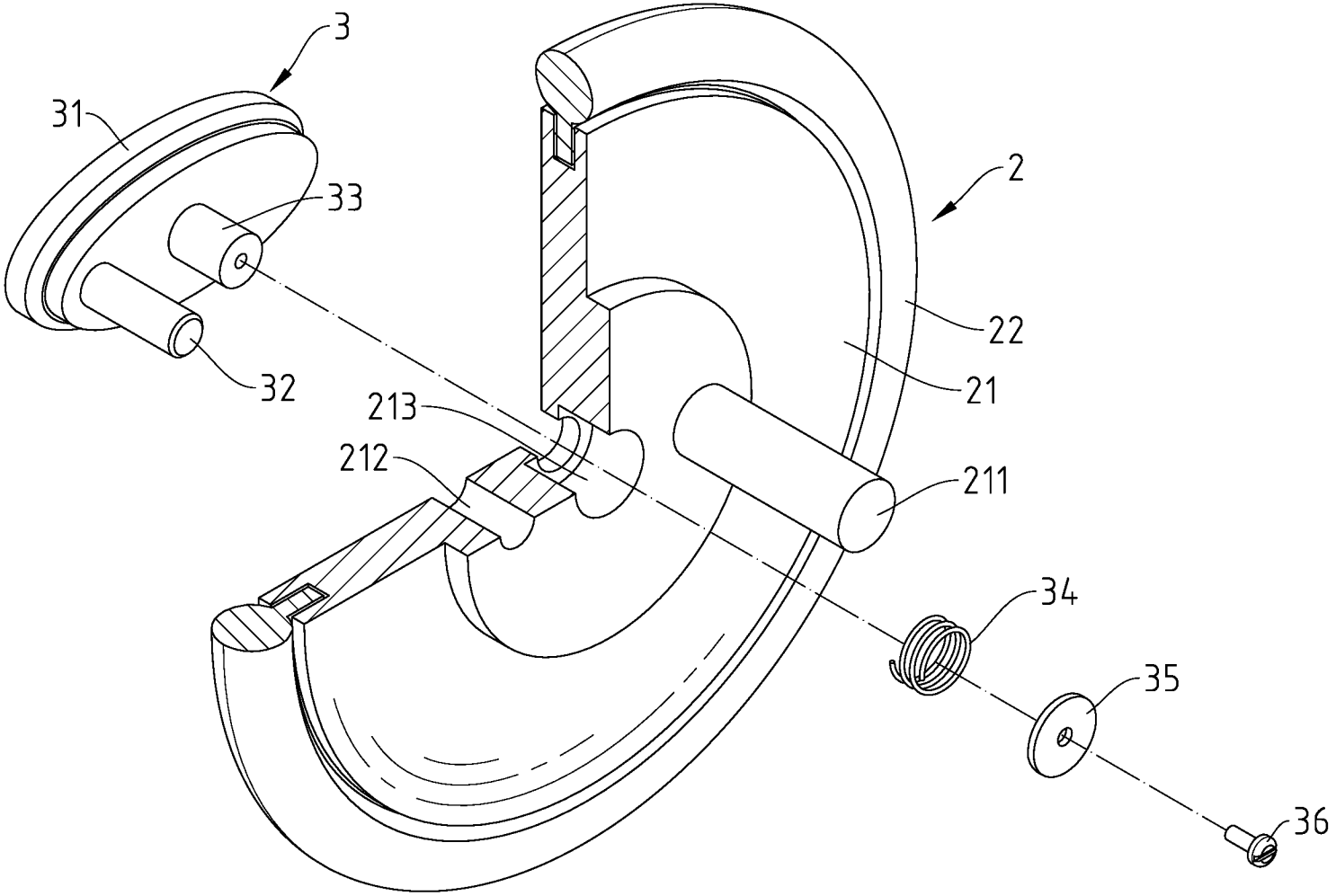
FIG. 8 is an exploded view of the locking device and the rotary displacement wheel.
Figure 9:
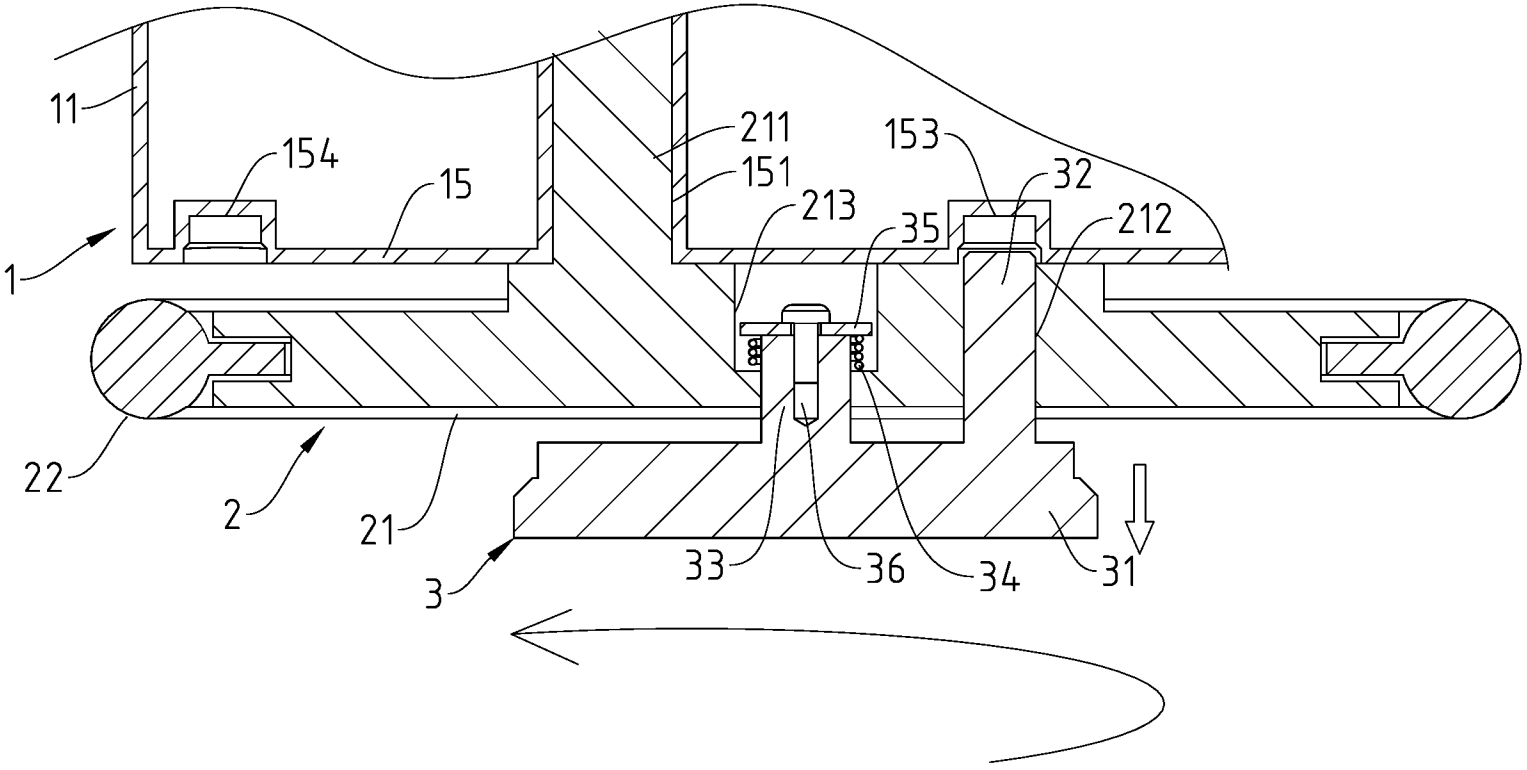
FIG. 9 is a schematic drawing illustrating the locking device unlocked the rotary displacement wheel.
Figure 10:
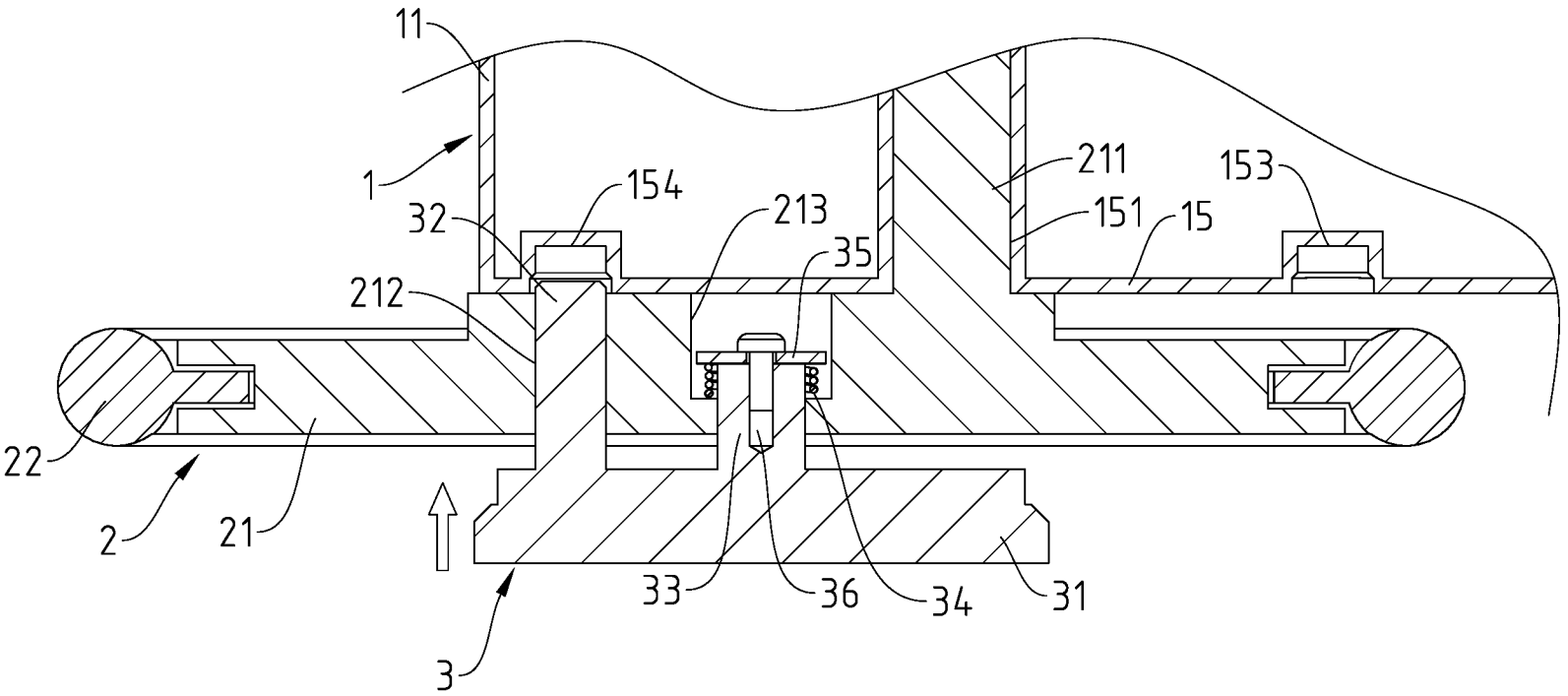
FIG. 10 corresponds to FIG. 9, illustrating the position of the rotary displacement wheel shifted to the second position.
Figure 11:
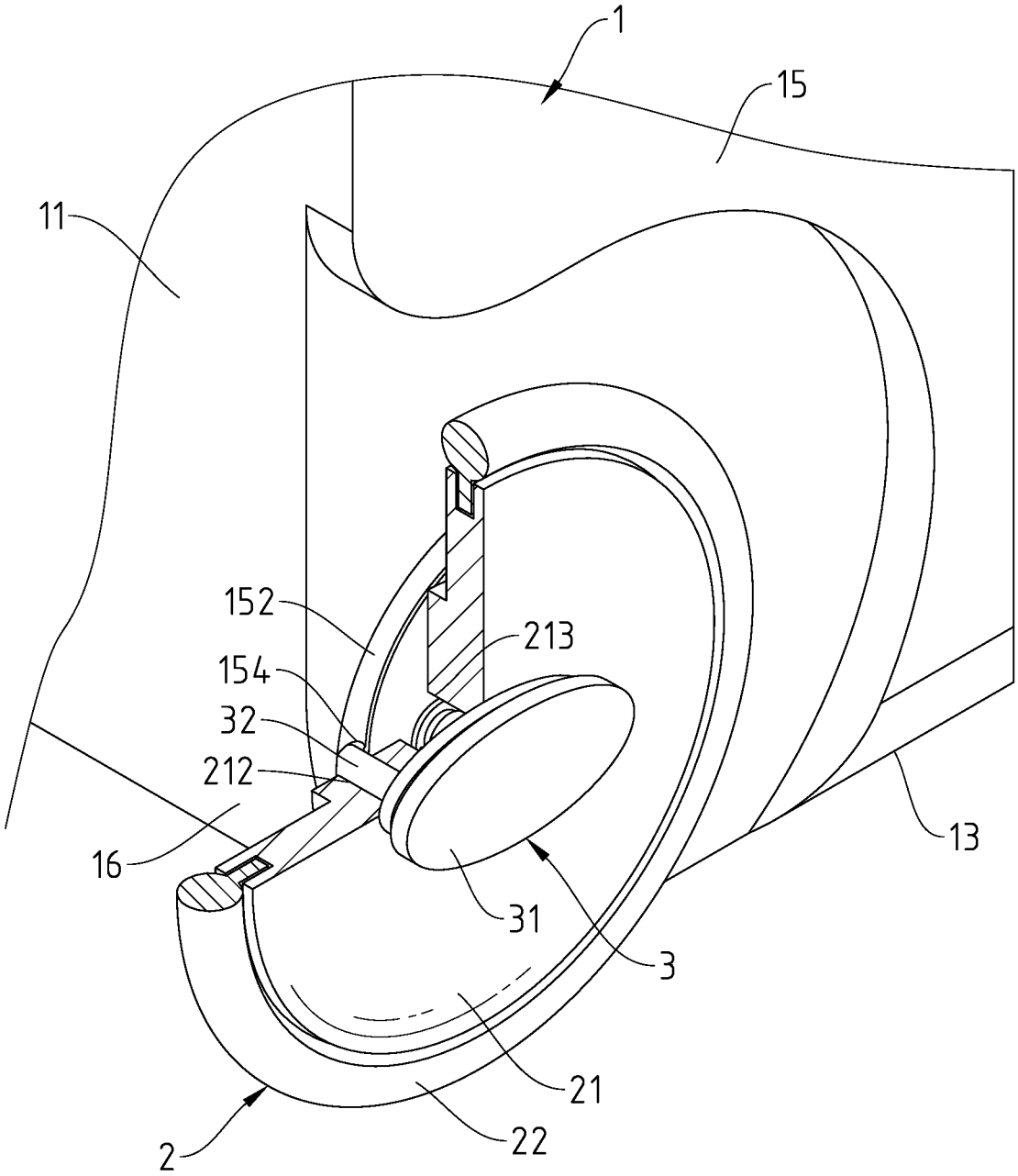
FIG. 11 is a sectional elevation of a part of the present invention, illustrating the rotary displacement wheel shifted to the second position.
Figure 12:
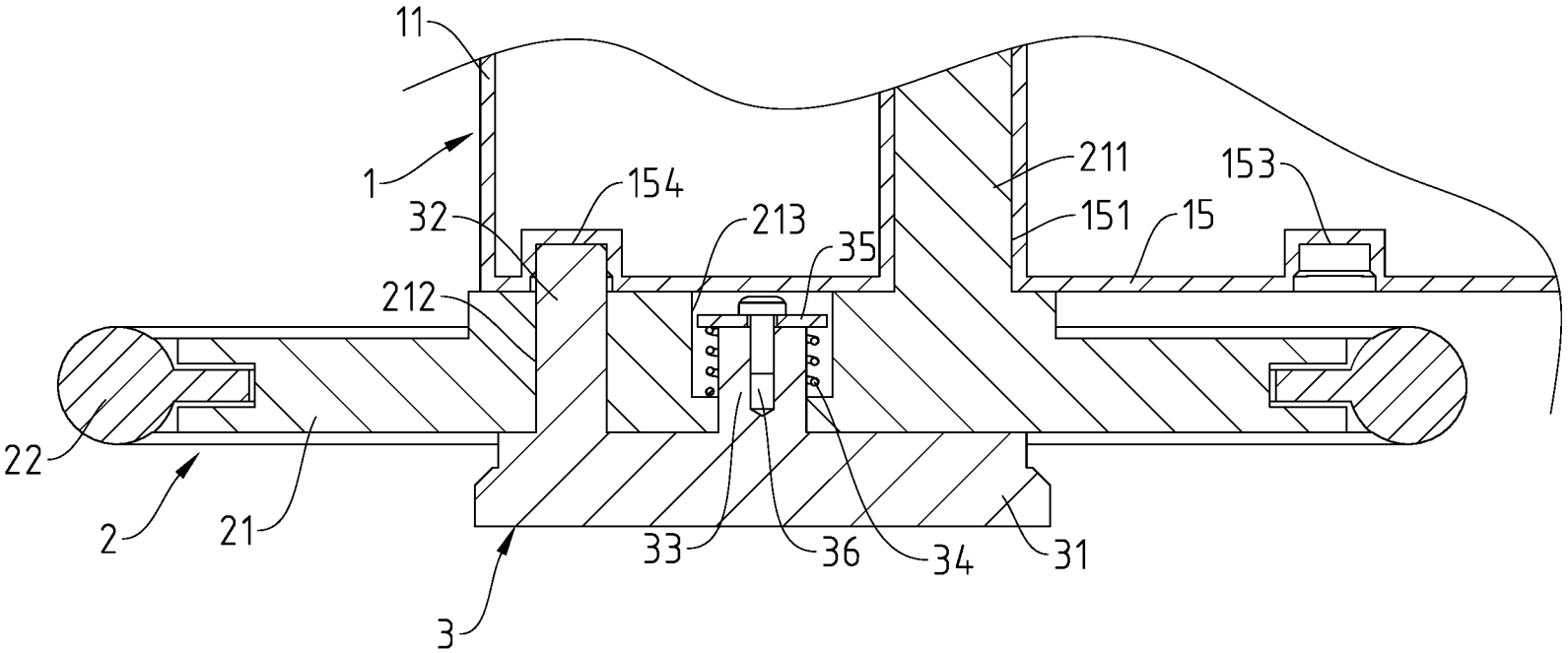
FIG. 12 is a schematic sectional view of the present invention, illustrating the rotary displacement wheel locked in the second position outside the luggage body.

As illustrated in FIGS. 5 and 6, when the wheel holder 21 is disposed near the front panel 12, the distal end of the positioning post 32 is positioned in the first positioning hole 153. When turn the wheel holder 21 far from the front panel 12, as illustrated in FIGS. 9-12, move the positioning plate 31 in direction away from the wheel holder 21 to disengage the distal end of the positioning post 32 from the first positioning hole 153, and then rotate the wheel holder 21. As soon as the positioning post 32 is aimed at the second positioning hole 154, the positioning plate 31 is moved back and attached to the wheel holder 21, forcing the distal end of the positioning post 32 into the second positioning hole 154.

What the invention claimed is:

1. A luggage, comprising:

a luggage body (1) comprising a back panel (11), a front panel (12), a bottom panel (13), a top panel (14) and two opposing side panels (15) respectively connected to one another, and a giving-away surface (16) located on the junction between said bottom panel (13) and said back panel (11) and inwardly recessed toward the inside of said luggage body (1); and a rotary displacement wheel (2) mounted to each said side panel (15) of said luggage body (1), said rotary displacement wheel (2) comprising a wheel holder (21) and a tire (22) pivotally mounted on said wheel holder (21) and peripherally protruding over said giving-away surface (16) of said luggage body (1), said wheel holder (21) being eccentrically pivoted to one respective said side panel (15) and disposed near said giving-away surface (16) and turnable between a first position near said front panel (12) and a second position far from said front panel (12).

2. The luggage as claimed in claim 1, wherein each said side panel (15) of said luggage body (1) comprises a pivot hole (151), an circularly arched sliding groove (152) extending around said pivot hole (151) and disposed far from said bottom panel (13), a first positioning hole (153) located on one end of said circularly arched sliding groove (152) near said front panel (12), and a second positioning hole (154) located on an opposite end of said circularly arched sliding groove (152) near said back panel (11); said wheel holder (21) of each said rotary displacement wheel (2) comprises an eccentric axle (211) perpendicularly extended from one side thereof and pivotally connected to said pivot hole (151) of one respective said side panel (15) of said luggage body (1) and a locking device (3) disposed at an opposite side thereof, said locking device (3) comprising a positioning plate (31) attached to the respective said wheel holder (21), a positioning post (32) extended from said positioning plate (31) and inserted through the respective said wheel holder (21) and positioned in the said circularly arched sliding groove (152) of one respective said side panel (15) so that when said wheel holder (21) is turned toward said front panel (12), said positioning post (32) is positioned in the said first positioning hole (153) of the respective said side panel (15); when said wheel holder (21) is turned away from said front panel (12), said positioning post (32) is positioned in the said second positioning hole (154) of the respective said side panel (15).

3. The luggage as claimed in claim 2, wherein said wheel holder (21) of each said rotary displacement wheel (2) further comprises a through hole (212) and position-limiting hole (213); said positioning post (32) of said locking device (3) is inserted through the said through hole (212) of the said wheel holder (21) of the respective said rotary displacement wheel (2) and engaged into the said circularly arched sliding groove (152) of the respective said side panel (15); said locking device (3) further comprises a position-limiting post (33) perpendicularly extended from the associating said positioning plate (31) and inserted in said position-limiting hole (213), a spring member (34) mounted on said position-limiting post (33) for imparting an elastic restoring energy to the associating said positioning plate (31) when the associating said positioning plate (31) is moved away from the respective said wheel holder (21), and a locating member (35) affixed to a distal end of said position-limiting post (33) to prohibit said position-limiting post (33) from falling out of the respective said position-limiting hole (213).

4. The luggage as claimed in claim 2, wherein the connection line between said pivot hole (151) and said second positioning hole (154) on each said side panel (15) of said luggage body (1) is parallel to said bottom panel (13).

* * * * *